US008075160B1

(12) United States Patent
Zarian

(10) Patent No.: US 8,075,160 B1
(45) Date of Patent: Dec. 13, 2011

(54) PRODUCT DISPLAY SYSTEM

(75) Inventor: James R. Zarian, Corona del Mar, CA (US)

(73) Assignee: JRZ Associates, LLC, Irvine, CA (US)

( * ) Notice: Subject to any disclaimer, the term of this patent is extended or adjusted under 35 U.S.C. 154(b) by 4 days.

(21) Appl. No.: 12/573,691

(22) Filed: Oct. 5, 2009

Related U.S. Application Data

(60) Division of application No. 11/459,211, filed on Jul. 21, 2006, now Pat. No. 7,597,448, which is a continuation-in-part of application No. 10/748,860, filed on Dec. 29, 2003, now Pat. No. 7,080,934.

(60) Provisional application No. 60/436,576, filed on Dec. 27, 2002.

(51) Int. Cl.
*F21V 33/00* (2006.01)

(52) U.S. Cl. ..... 362/253; 362/234; 362/154; 362/647

(58) Field of Classification Search ..... 362/20, 362/84, 101, 154, 155, 156, 125, 234, 253, 362/800, 640, 647, 652, 658, 659
See application file for complete search history.

(56) References Cited

U.S. PATENT DOCUMENTS

| | | | | |
|---|---|---|---|---|
| 3,834,351 | A * | 9/1974 | Schmidt | 119/266 |
| 4,682,078 | A * | 7/1987 | Pascalide | 315/86 |
| 5,178,450 | A * | 1/1993 | Zelensky et al. | 362/154 |
| 5,311,413 | A * | 5/1994 | Farmer et al. | 362/154 |
| 5,459,648 | A * | 10/1995 | Courtney | 362/154 |
| 6,793,362 | B2 * | 9/2004 | Tai | 362/101 |
| 7,040,776 | B2 * | 5/2006 | Harrell et al. | 362/154 |

* cited by examiner

*Primary Examiner* — Bao Q Truong

(74) *Attorney, Agent, or Firm* — Gerry J. Elman; Elman Technology Law, P.C.

(57) ABSTRACT

A product display system is disclosed. The product display system provides various means for illuminating products displayed. External and internal illumination means are disclosed, as well as internal and external power sources. In some embodiments, the displayed product switches from an external power source to an internal power source when the product is removed, allowing the product to remain illuminated for a considerable length of time.

16 Claims, 10 Drawing Sheets

PRODUCT DISPLAY SYSTEM

FIELD OF THE INVENTION

This invention pertains to the field of product displays. More particularly, it pertains to methods and apparatuses for illuminating the products on display.

BACKGROUND OF THE INVENTION

Glowing, illuminating, luminescent items or items including light source(s) for both functional and decorative applications are popular. Such items, for example, can be used in stores for promotion to increase sales. In most applications at the present time, light is projected onto an item to make it more visible and attractive. More recently light sources have been integrated into the items themselves. However, powering some of these items suffer in many areas including high cost, low battery life, complicated and large components and the like.

The prior art devices are subject to several disadvantages. For example, in instances where an item does not contain an integrally included light source and is illuminated through the base, some of the light is lost as the base of the container causes scattering and inappropriately disperses the light. In other instances, the emitted light is very intrusive to an observer negating the desired effect. Further, in instances where multiple containers may be displayed, the physical form of the emitting sources can be rather large and prohibitive.

Other disadvantages of prior art fixtures and devices and the associated lighted items are realized when the items are operated by an internal power source such as batteries. The battery operated items have a relatively short life and are not suitable to display for long periods of times such as days or weeks. Therefore, what is needed is an apparatus and method for improved illumination of products being displayed.

SUMMARY OF THE INVENTION

The present invention provides embodiments comprising of fixtures and/or devices, illuminated, lighted, and luminescent items and display screens.

The present invention also provides lighted items that luminesce, illuminate or have a lighted element.

The present invention also provides embodiments comprising of fixtures and/or devices and lighted items for display and other functional applications.

The present invention also provides embodiments comprising of fixtures and/or devices and display screens, which have functional applications.

The present invention also provides embodiments comprising of fixtures and/or devices, lighted items that are luminescent, illuminate or have a lighted element for display and other functional applications and display screens for relatively long periods of times such as days, months or even years.

The present invention also provides embodiments comprising of fixtures and/or devices, lighted items that are luminescent, illuminate or have a lighted element and display screen whereby the item or display screen has no integrally included lighting element of its own, and whereby the light source and power source are external to the item.

The present invention also provides embodiments comprising of fixtures and/or devices, lighted items that are luminescent, illuminate or have a lighted element and display screens whereby the item has at least one light source integrally included and a power source is external to the item.

The present invention also provides embodiments comprising of fixtures and/or devices, lighted items that are luminescent, illuminate or have a lighted element and display screen whereby the fixtures and/or devices function as an external power source for the purpose of supplying power to the light source of the item or the display screen.

The present invention also provides means to configure the external power source in a manner to allow for more than one lighted item or display screen to be functional.

The present invention also provides a unique external power source that supplies power to more than one lighted item or display screen.

The present invention also provides embodiments of fixtures and/or devices, lighted items that are luminescent, illuminate or have a lighted element or display screens whereby the items integrally include at least one light source and an internal power source, whereby the fixtures and/or devices function as an external power source for the purpose of supplying power to the light source or display screen, while the item is attached to the fixture and/or device.

The present invention also provides a method for the lighted item or display to be configured with an integrated power source to supply power to the light source once the item or display screen has been removed from the fixtures and/or devices previously being the external power source.

The present invention also provides a method for the item or display screen with an integrated power source to be configured, whereby the integrated power source is charged and the lighted item remains on by being powered by the external power source while on display; and, the item or display screen to remain lighted once the item has been removed from the fixtures and/or devices.

The present invention also provides fixtures and/or devices such that they not only provide power to the lighted item(s) or display screen(s) (e.g. external power source), but also serve a complimentary function.

The present invention also provides fixtures and/or devices such that they not only provide power (e.g. external power source), but also serve the function of holding the lighted items.

The present invention also provides fixtures and/or devices such that they not only provide power (e.g. external power source), but also serve the function of holding the display screens.

The present invention also provides fixtures and/or devices such that they not only provide power (e.g. external power source), but also allow the lighted items or display screens to rest on the fixtures and/or devices.

The present invention also provides fixtures and/or devices such that they not only provide power (e.g. external power source), but also allow the lighted items or display screens to hang on the fixtures and/or devices.

The present invention also provides a product display system. The product display system provides various means for illuminating products displayed. External and internal illumination means are disclosed, as well as internal and external power sources. In some embodiments, the displayed product switches from an external power source to an internal power source when the product is removed, allowing the product to remain illuminated for a considerable length of time.

In one aspect of the invention, the invention provides a container dispensing apparatus, comprising; a means for storing a plurality of containers, each of the containers having a cap at the top, the cap having at least a portion of the top allowing light to pass through it; a plurality of illuminating means, including at least a first illuminating means; and a second illuminating means, each illuminating means placed above one of the containers, whereby each illuminating means is aligned with the cap of one of the containers, such that light from the illuminating means passes through the cap, and into one of the containers; and a means for guiding each of the containers, whereby when a container is removed from the container dispensing apparatus, the container aligned under the first illuminating means moves to a new position aligned under the second illuminating means.

In another aspect of the invention, the invention provides a container cap comprising, an outer portion; an inner portion; an illumination means affixed to the inner portion; and a conductive means affixed to the outer portion and connected to the illumination means; whereby electrical power from an external power source applied to the conductive means causes the illumination means to illuminate.

In another aspect of the invention, the invention provides a container cap comprising, an outer portion; an inner portion; an illumination means affixed to the inner portion; and a power source contained within the inner portion and connected to the illumination means; whereby electrical power from the internal power source causes the illumination means to illuminate.

In another aspect of the invention, the invention provides a container holding device comprising, holding means for holding at least one container having the cap of the present invention, and means for supplying electrical power to the cap.

In another aspect of the invention, the invention provides a product having an illumination means, internal power source, switching means, and external power receiving means, whereby the switching means switches the power from the external power source to the internal power source when the external power is not present.

These and other features and advantages of the invention will become more apparent upon reading the following description of the preferred embodiment taken together with the drawings appended hereto.

BRIEF DESCRIPTION OF THE DRAWINGS

FIG. 7A comprises of a device holding an item in addition to external and internal power supply details and switching means for supplying power to the light elements when removed from the fixture, by switching the power from the external power source to the internal power source, when the item is removed without any interruption.

DETAILED DESCRIPTION

Figure 1A:
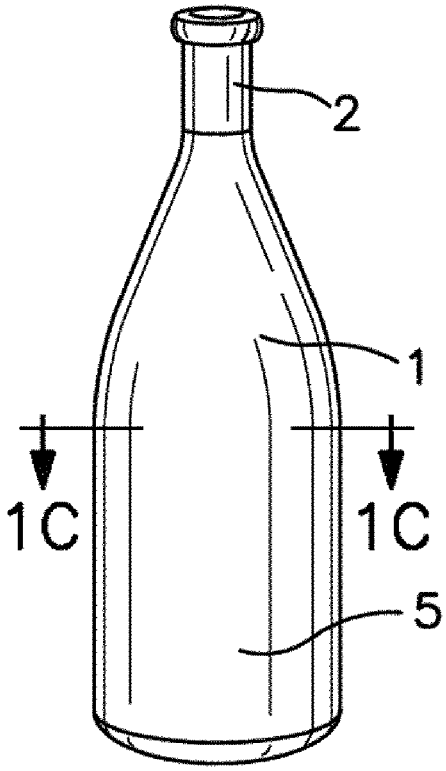
FIGS. 1A (container and cap), 1B (cap detail), and 1C (top view of cap) show a representation of a container with a cap, which includes a clear opening to accept light from an illumination source, such as a light emitting diode ("LED"), fiber optic light source, or small incandescent light source. In a preferred embodiment, an LED is used. The projected light through the clear portion of cap is dispersed by the contents making the container luminesce. The source of power to the LED is not shown.

This invention is useful for making objects and/or items luminance, illuminate, glow or has lighted elements and/or display screens that are functional, pleasing and noticeable for home or commercial use.

The light source for this invention is not limited to any type of light source; however, light emitting diodes ("LEDs") are the preferred light source. The reason being that LEDs are efficient, operate at low voltage, reasonably inexpensive, have rich and dazzling colors and have relatively higher flux among other attributes. One of the more significant attributes of LEDs is the compactness and small physical form allowing applications not possible before. Another advantage offered by LEDs is their capability to run on compact energy sources such as batteries, which in turn allow illuminated mobile systems to be developed (i.e., mobile phones, personal data assistants, digital clocks, MP3 players, medical sensing devices having liquid crystal display devices, e-books having liquid crystal display devices or organic light emitting diode devices, etc.).

Similarly, organic light emitting diodes ("OLED") have recently been developed that can be readily deposited on substrates such as polymers and used for display purposes (display screens). OLED-based displays are addressable, efficient, operate at low voltage, are reasonably inexpensive, have rich and dazzling colors and have relatively higher flux in comparison to other "digital" displays such as back-lighted liquid crystal displays. One of the more significant attributes of OLED displays is the flexibility and thinness allowing applications not possible before. Another advantage offered by OLED, similar to LEDs, is their capability to run on compact energy sources such as batteries, which in turn allow display screens to be developed (i.e., mobile phones, personal data assistants, digital clocks, MP3 players, medical sensing devices, e-books, etc.).

The OLED display technologies extend to bi-stable display technologies, which possesses the uncanny ability to retain on-screen images even after the power has been turned off. As the term bi-stable implies, the picture elements are stable in two (or more) states. The display needs power only when the content changes. The power efficiency that a bi-stable display can bring to a display is significant, since often the same information remain for extended period of times on display. In commercial applications, for instance, management of a store can change information such as prices on items being displayed automatically.

Arrangements for promotional applications where an item such as a beverage bottle includes integrally included LED(s) and power source such as battery(s) has been disclosed in prior art. However, in certain arrangements the inclusion of an LED and a power source such as a battery is not economically feasible and/or is structurally prohibitive. In such circumstances, according to the present invention, the container(s) may be provided with a clear cap and light from an LED projected into the container through the clear cap. The cap is configured to allow the maximum light emitting from the LED to reach the contents of the container. It is understood that a power source is provided externally.

Figure 1B:
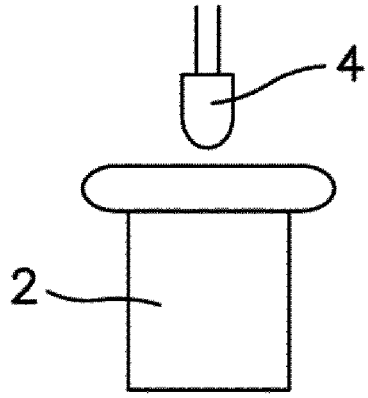
Figure 1C:
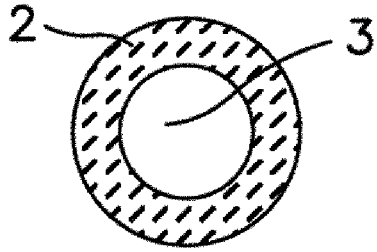

Referring to FIGS. 1A, 1B, and 1C, container 1 is provided with a cap 2 having a clear opening 3, opening 3 having means to accept maximum light from LED 4 projecting light efficiently onto the contents 5 making the container 1 luminesce when the LED 4 is activated. Opening 3 may advantageously be arranged to have a concave shape on the top and a convex shape on the bottom. Other optical arrangements for opening 3 to accept maximum light from LED 4 and most effectively project light onto contents 5 for the purposes of this invention are within the scope of this invention and are contemplated.

Figure 2:
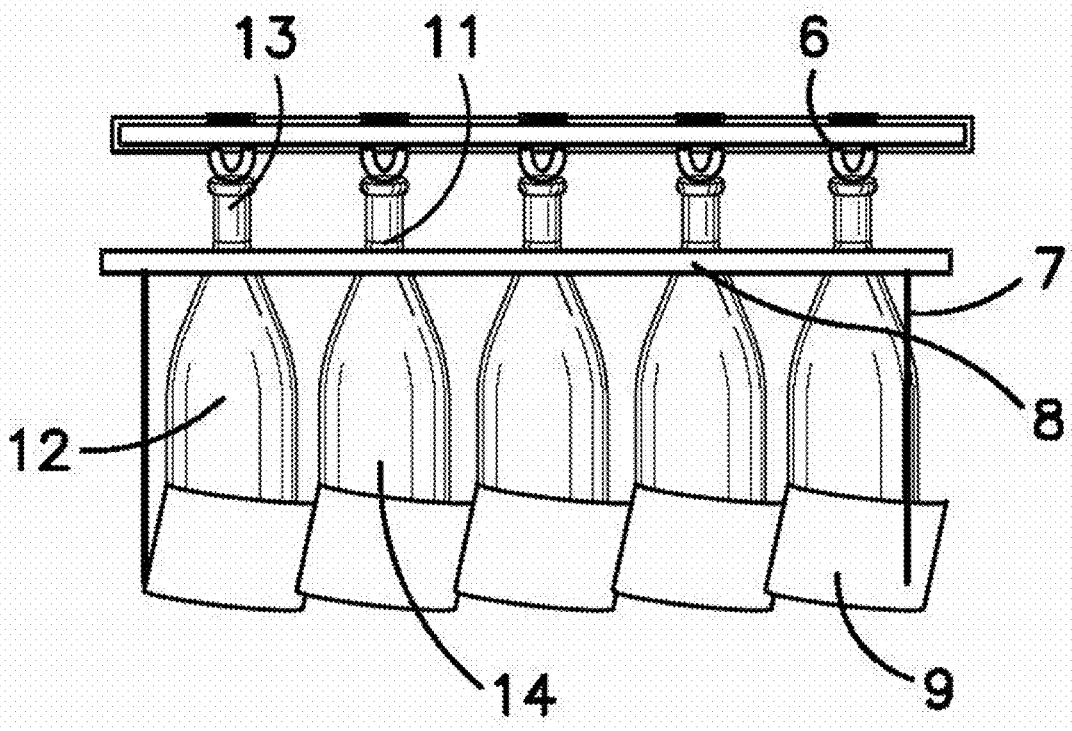
FIG. 2 is a representation of a fixture with LEDs, the fixture further having guiding means that act as an indexing mechanism to advantageously place the LEDs onto the caps of containers. The caps, similar to the embodiment in FIG. 1 have clear openings to accept maximum light from LEDs onto the contents and making the container luminesce. The guiding means allow another container to move forward progressively as one container is removed.

Referring to FIG. 2, a series of LEDs 6 my be arranged on a fixture 7, fixture 7 having a top 8 and a bottom 9, top 8 and/or bottom 9 having guiding means that act as an indexing mechanism to advantageously place the LEDs 6 onto the caps 11 of containers 12, each cap having a clear opening 13, opening 13 having means to accept maximum light from each LEDs 6 projecting light efficiently onto the contents 14 making the container 12 luminesce when the LEDs 6 are activated. Fixture 7 has means to allow another container to move forward progressively as one container is removed. In such an arrangement a multiple of containers 12 are always luminescing. Further, since the power is supplied through the fixture, from an external source such as an electric outlet, to long lasting LEDs, the embodiment can light up numerous items over a long period of time such as days, months or even years.

In certain arrangements the inclusion of an LED is feasible; however, the inclusion of a power source such as a battery is not economically feasible and/or is structurally prohibitive. In such circumstances, according to the present invention, the items(s) may be provided with an LED as a light source, and in order to provide power for long periods of time, an external power source can be employed.

Figure 3:
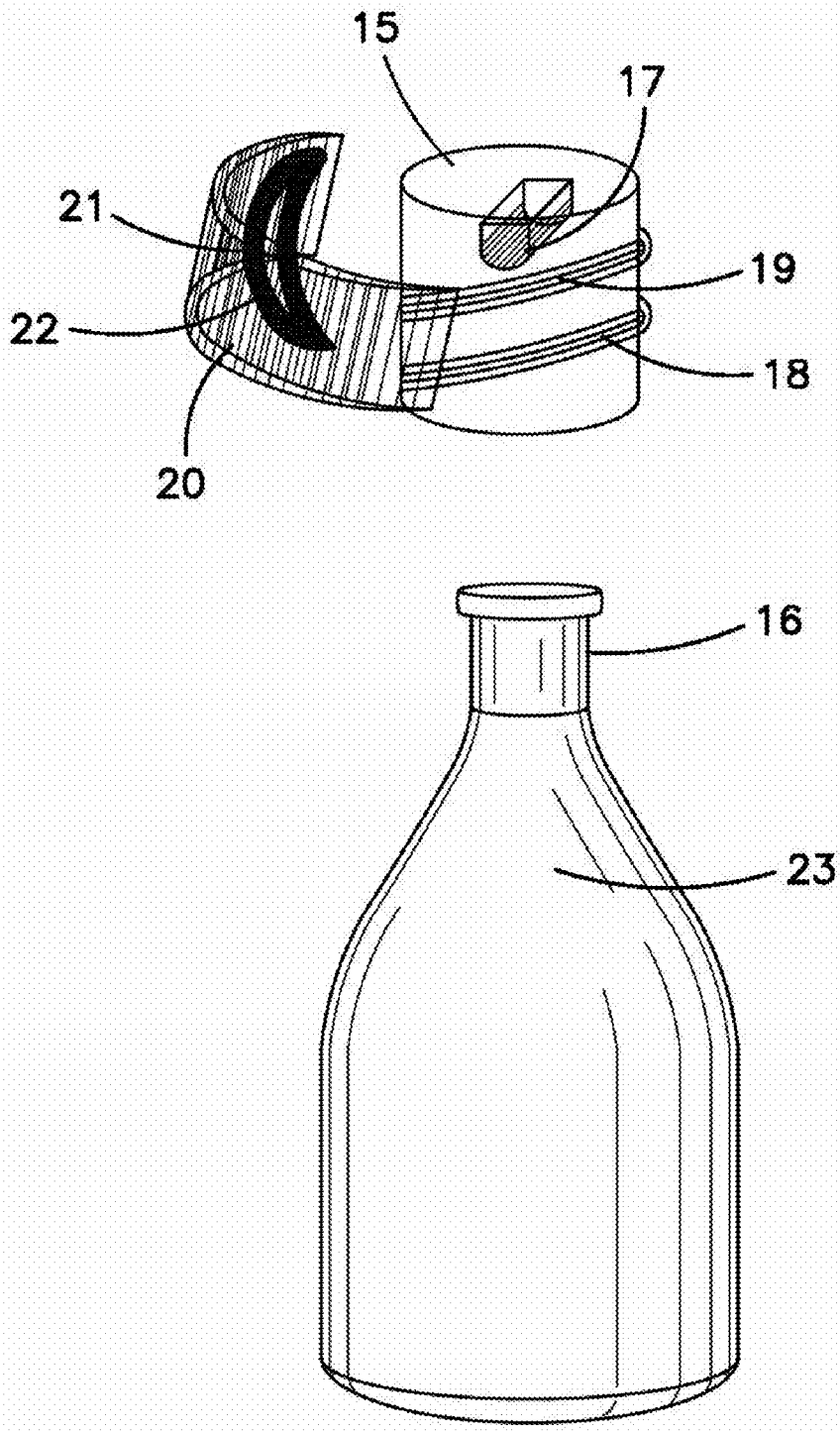
FIG. 3 is a representation of an embodiment with a cap, with an LED arranged inside the cap, the cap further having conductors external to the cap, accessible from the outer surface of the cap, and having electric connections to the LED. The LED when activated by an external power source provides light to the embodiment.

Referring to FIG. 3, a cap 15 for a container 16 comprises an LED 17 arranged inside the cap 15, the cap 15 further having positive conductor 18 and negative conductor 19 placed external to cap and having electric connections to LED 17. Cap 15 when activated by an external power source 20 having conductors 21 and 22 projects light onto the contents 23 contained within the container 16, making the container glow.

Figure 4A:
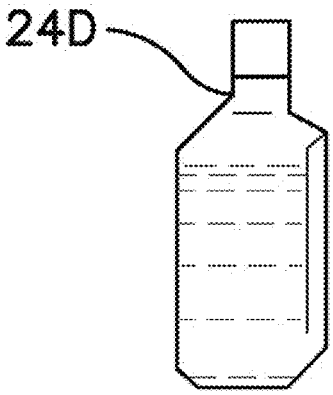
FIGS. 4A and 4B represent an embodiment prior to (normal) and after (glowing) the light source has been activated by an external power source according to the preferred embodiments of this invention.
Figure 4B:
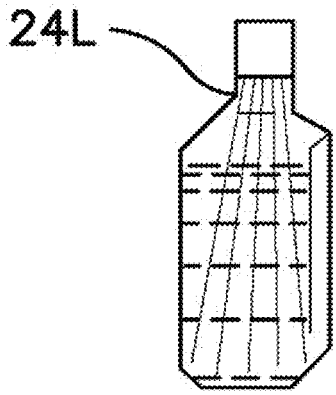
Figure 4C:
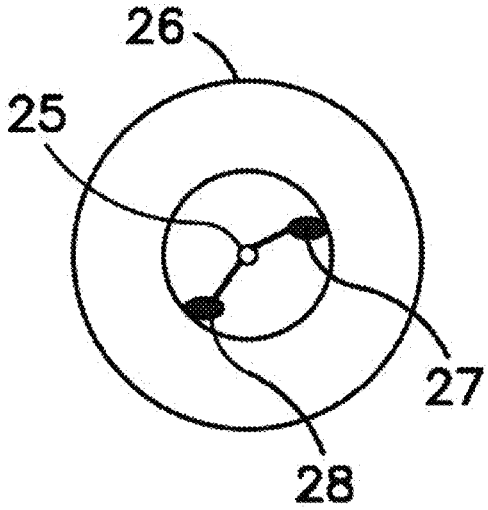
FIG. 4C shows a plan view of the interior of a container cap of this embodiment.

In an alternative embodiment, referring now to FIGS. 4A, 4B, and 4C: FIG. 4A shows a container 24D prior to activation of LED 25. FIG. 4B shows container 24L after activation of LED 25. FIG. 4C shows LED 25 arranged inside the cap 26. The power is supplied to LED 25 by an external power source (e.g., batteries) and with two thin wires (not shown). The wires are advantageously configured to make contact with the conductors 27 and 28 inside the cap.

In a commercial application such as in a store, where an item such as the embodiment in FIG. 3 is displayed, a platform may be provided with the electric power conductors on the upper surface of the platform; and the item to be displayed provided with conductors originating from the bottom of the item, extending along the item and in communication with the illumination element. The platform may actually be configured to hold multiple containers all glowing when activated and allowing new items placed on the platform to glow.

It is understood that the lighted item in FIG. 3 does not have to necessarily be a container and other items such as cell phones, toys, cosmetics, toiletries, stationary items and such are contemplated within the scope of this invention.

It is also understood that circuitry may be included within the items to achieve desired results such as blinking, to reduce voltage, to regulate output or cause color changing as desired.

It is further understood that the circuitry included within the items to achieve desired results such as blinking, to reduce voltage, to regulate output or cause color changing as desired can be controlled wirelessly.

Figure 5A:
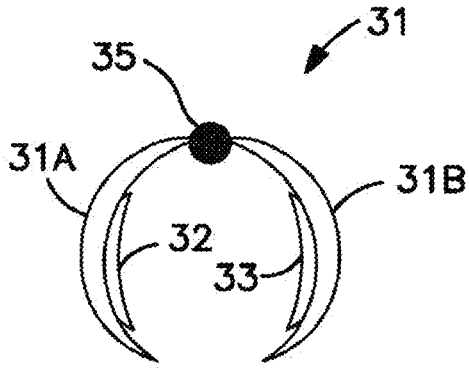
FIGS. 5A, 5B, and 5C represent an embodiment which functions as an external power source for a multiple of items as well as holder for the items.
Figure 5B:
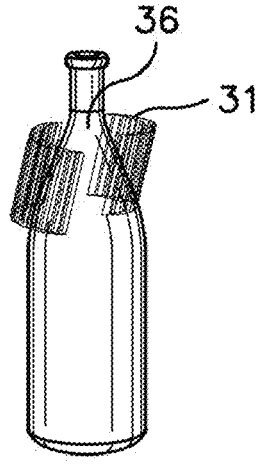
Figure 5C:
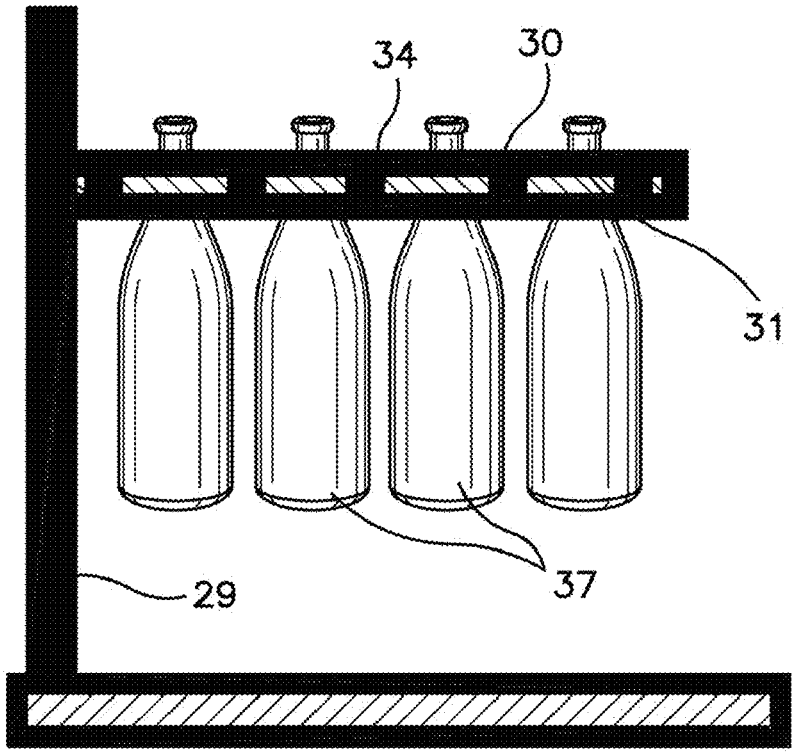

Referring to FIGS. 5A, 5B, and 5C, fixture 29 is configured to provide external power supplying arrangements 30. Each external power supplying arrangement 31, in this instance, functions as a holder as well as a conductor, each holder/connector 31 having conductors 32 and 33. There are means 34 provided to allow the holder/connectors to move independently, and have means such as a spring hinge 35 to exert a holding force on the caps 36. FIG. 5A shows a preferred embodiment of the holder 31. In this case, the holder is composed of two members 31A and 31B, permanently fastened together at one end via spring hinge 35, and detached at the other end, with spring hinge 35 forcing the detached end of the two members 31A and 31B together to hold a container such as a bottle. When it is desired to remove a container, the user may pull the container outward to overcome the spring tension and release the container. Each holder/connector 31 advantageously arranged to provide power to conductors of lighted items 37, each item having at least one illumination element 38. Fixture 29 provides power to multiple items 37 and may be arranged to have means to allow items 37 move progressively forward as one item is removed. In such an arrangement a multiple of items 37 are always luminescing. Further, since the power is supplied through the fixture, from an external source such as an electric outlet, to long lasting LEDs, the items can light up numerous items for a long period of time such as days, months or even years.

Figure 6:
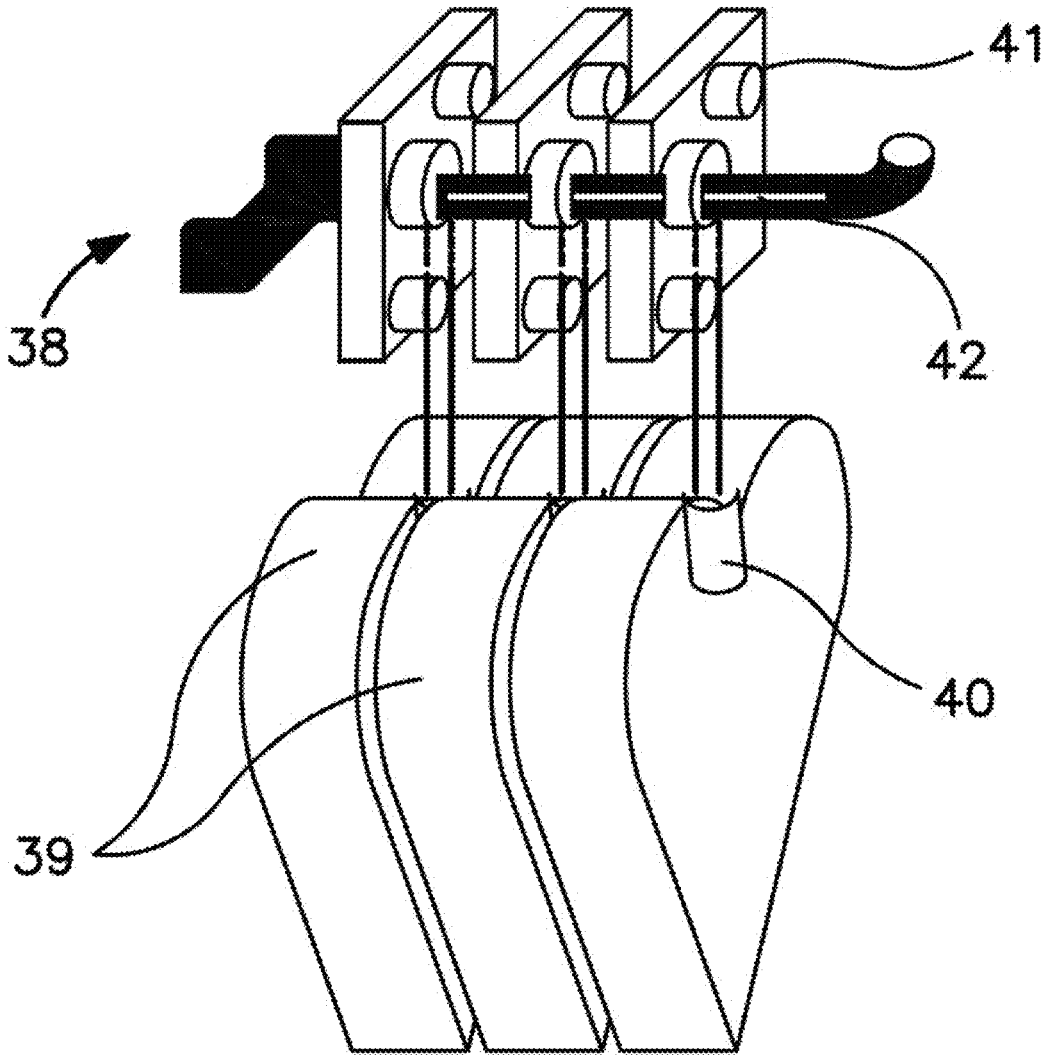
FIG. 6 represents an embodiment comprising fixtures and/or devices and multiple items or display screens. The items or display screens, in addition to the light elements, each include an internal power source for purpose of supplying power to the light elements when removed from the fixture by switching the power from the external power source to the internal power source, when each item or display screen is removed without any luminescing interruption.

Referring to FIG. 6, the present invention in the form of a product display system is shown. The product display system 38 comprising fixtures and/or devices has multiple products (also referred to as items) 39 that can be lit. Items 39, in addition to the light elements 40, each may include an internal power source such as a battery or capacitors 41 for purpose of supplying power to the illumination source (also referred to as light elements) 40 when removed from the fixture and/or device. However, the life of such internal power sources 41 would be short and finite. To keep the items 39 lit for a longer period of time, the product display system 38 is configured to supply power to the light elements 40. It is understood that appropriate circuitry and arrangements are made for the power to reach the light elements 40 from external power sources 42 by bypassing the internal power sources 41.

Figure 7A:
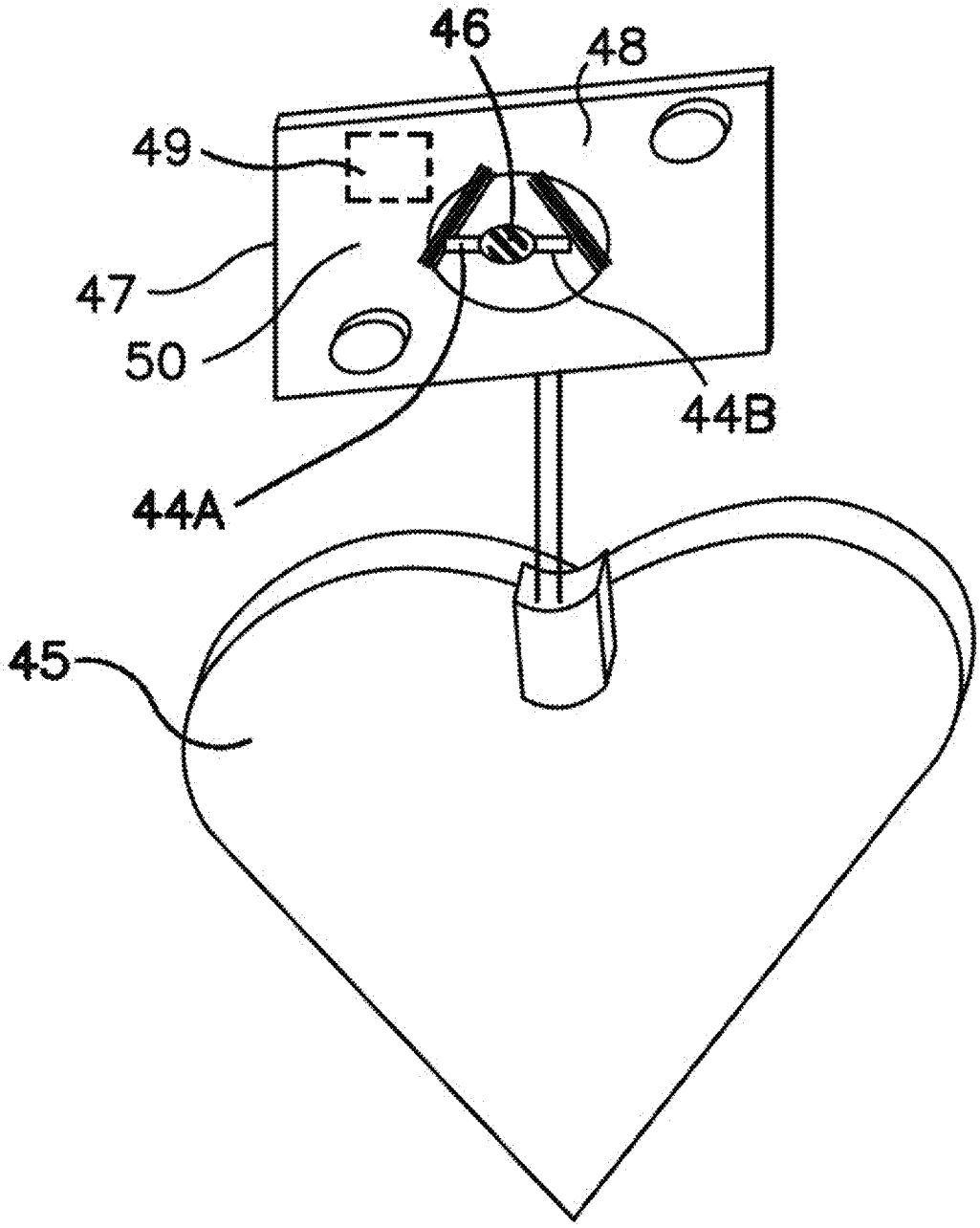
FIG. 7A represents the embodiment of FIG. 6 in more detail.

In an alternative embodiment, again referring to FIG. 6, in addition to the appropriate circuitry and arrangements made for the power to reach the light elements 40 from external power sources 42 by bypassing the internal power sources 41, while the items are in contact with the fixture and/or devices 38; means are provided to switch the power from the external power source 42 to the internal power source 41, when the item 39 is removed from product display system 38 to allow the item 39 to remain lit. The means may be, for instance, a pressure-sensitive mechanism that inactivates the internal power source by the weight of the item resting on the mechanism, and switching the power source from the external power source to the internal power source maintaining the item lit without any interruption when the item is removed. FIG. 7A shows such a mechanism in more details.

Referring to FIG. 7A, there is shown details of device 43, having two conductors 44A and 44B, isolated from each other by the insulating medium 46. Device 43 is preferably attached to a peg as part of a product display (not shown), and is holding item 45 and making electrical contact with the conductors 47 and 48 of switching means 49. Switching means 49, for instance, being a pressure-sensitive mechanism that inactivates the internal power source 50 by the weight of the item resting on the device 43, and switching the power source from the external power source (e.g., device 43) to the internal power source 50 maintaining the item 45 lit without any interruption when the item 45 is removed from device 43. In another embodiment, the switching means detects the interruption of external power, and switches to internal power at that time.

In an alternative embodiment, again referring to FIG. 6, in addition to the appropriate circuitry and arrangements made for the power to reach the light elements 40 from external power sources 42; means may be provided to recharge the internal power sources 41, while the items are in contact with the fixture and/or devices 38. The latter is in addition to means provided to switch the power from the external power source 42 to the internal power source 41, when the item is removed to allow the item to remain lit. Such an embodiment may prove valuable in instances where an item is repeatedly displayed and used such as a drinking container in a bar.

Figure 7B:
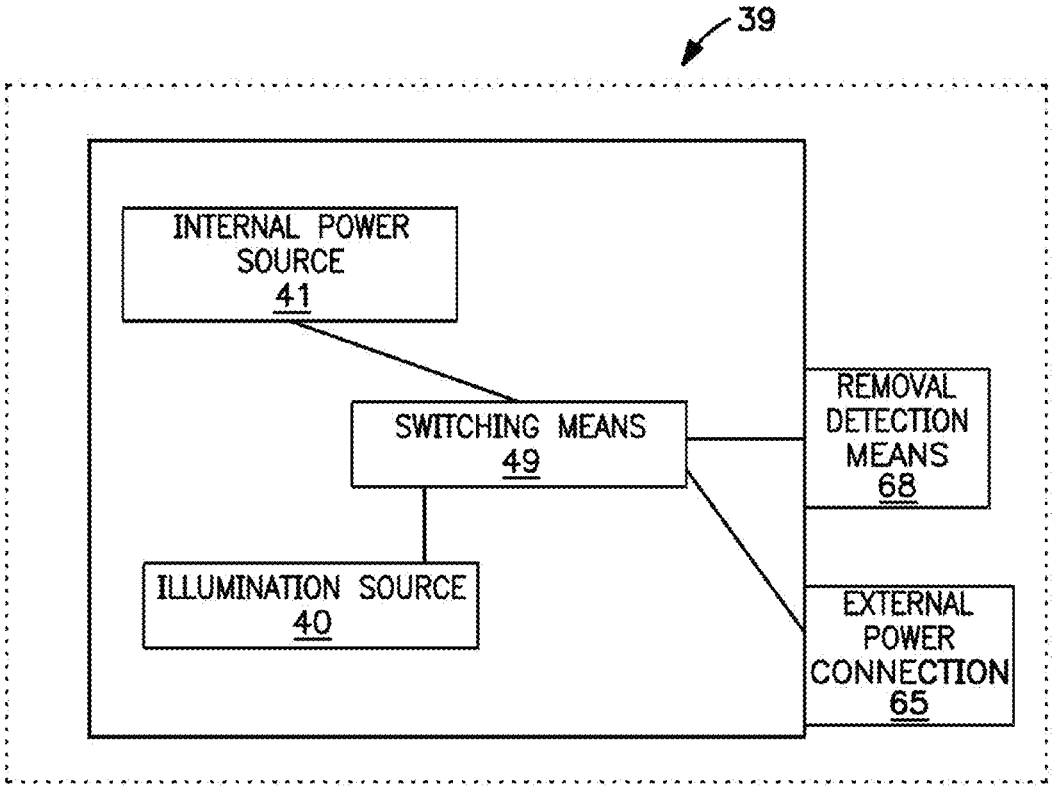
FIG. 7B represents a block diagram of a product (also referred to as "item") as so defined by the present invention.

FIG. 7B shows a block diagram of an exemplary product (item) 39. In general, a product contains an internal power source 41, and illumination source 40, and switching means 49. The switching means 49 routes power from the appropriate power source to illumination source 40. In general, if power is available from external power connection 65, then the switching means 49 routes power from an external power receiving means such as the external power connection 65 to illumination source 40. If the external power is not available, switching means 49 routes power from internal power source 41 to illumination source 40. In one embodiment, the switching means 49 comprises a power interruption detection circuit that detects the absence of external power and automatically switches to internal power. In another embodiment, a removal detection means 68 is used to determine when product 39 is present on the product display system. In one embodiment, removal detection means 68 comprises a pressure-sensitive mechanism that provides a signal to switching means 49 based on the weight of the product 39 resting on the device 43 (FIG. 7A). If sufficient weight is detected, as caused by product 39 hanging on device 43 (FIG. 7A), then switching means 49 disconnects the internal power source 41 from the illumination source 40, and routes power from the external power connection 65.

Figure 8:
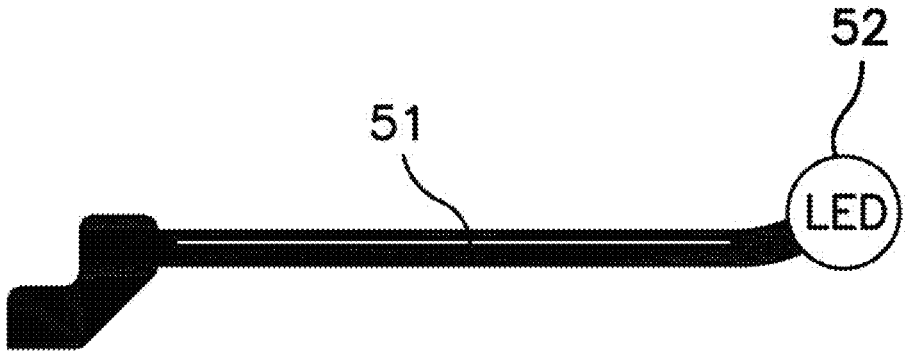
FIG. 8 represents an embodiment, which functions as an external power source for multiple of items, holder for the items, and integrally includes a light source.

Referring to FIG. 8, there is shown details of a peg, referred to as device 51, in which a lighting element such as an LED 52 has been placed at the tip of the device 51 to make the device more pronounced. For instance the management turns the LED 52 on to indicate a reduction on prices of the items that would be hanging on device 51 as part of a product display.

Figure 9:
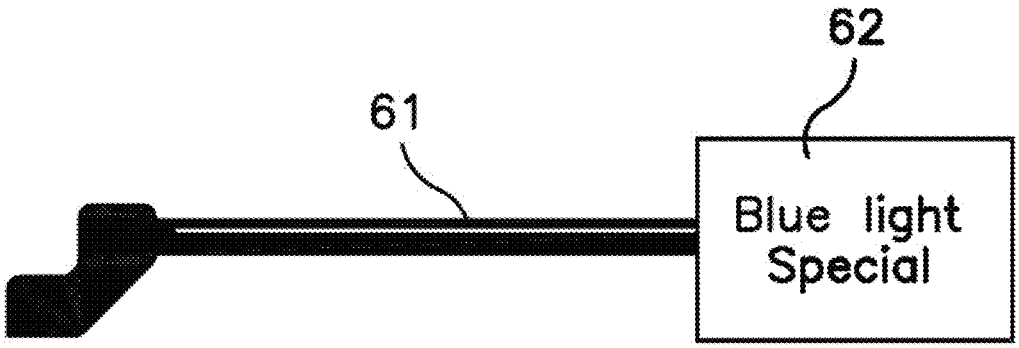
FIG. 9 represents an embodiment, which functions as an external power source for multiple of items, holder for the items, and integrally includes a display screen.

Referring to FIG. 9, there is shown details of a peg, referred to as device 61 having display 62. The display 62 may be capable of displaying various other symbols instead of, or in addition to alphanumeric characters. Various display technologies may be used. In a preferred embodiment, display 62 is OLED-based, and is used to convey messages. It is understood that the display 62 is not limited to OLED-based displays and other type of displays such as liquid crystal displays, electroluminescent, cold cathode displays among other type of displays can be readily used.

Figure 10:
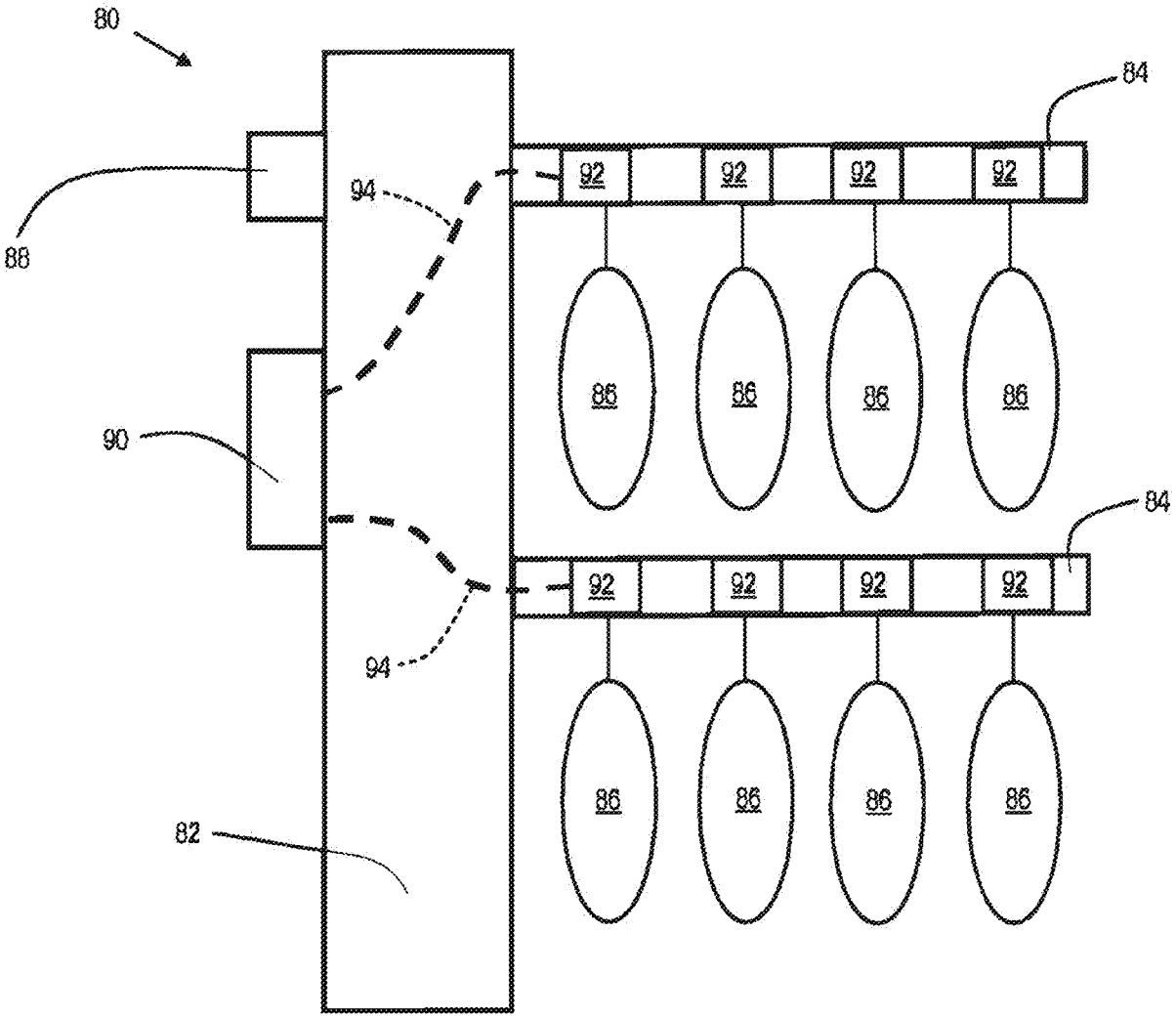
FIG. 10 represents an embodiment which provides for multiple holders.

FIG. 10 shows a product display system 80 comprising multiple holders, each holder referenced as 84. Each holder 84 is supported by fixture 82. Fixture 82 is oriented substantially vertically, and provides support for each holder 84, which protrudes approximately perpendicularly from fixture 82. Each holder 84 has the capability to hold a plurality of items 86. Each item 86 uses the same means as item 45 of FIG. 7A in terms of power switching. When device 86 is suspended from holder 84, it receives power from external power source 90. The power from external power source 90 is electrically connected to each holder 84 via an internal wiring harness 94. Each holder 84 has a plurality of contact points 92 installed at regular intervals, at which point an item 86 may be attached using the means described for device 43 of FIG. 7A. While not shown in the drawing, there is means to electrically connect all contact points 92 to wiring harness 94, as can be appreciated by one of ordinary skill in this art. The power is controlled via control panel 88. In the simplest embodiment, control panel 88 provides an on-off switch to disconnect power from the holders 84. Control panel 88 may optionally include other features, such as a timer to automatically turn the product display system 80 on and off at predetermined times (e.g. when a store opens and closes). Control panel 88 may be controlled from a remote location such as central control room by wire or wirelessly.

EXAMPLES AND METHODS

Example and Method 1

FIG. 2

A fixture of an embodiment, according to the present invention may be a shelf inside a refrigerator in a store, the shelf has a rack device; the device has a series of LEDs placed at predetermined spaces, and the rack additionally also has been configured to hold containers such as beverage bottles. The LEDs on the rack receive power from wires connected to the rack and remain illuminated. The beverage bottles, which have clear tops, are fed from the back of the rack to the front to be kept cold and displayed. The rack have spring action, whereby the bottles are moved forward and at the same time kept in predetermined location underneath the LEDs, the bottles slide from one portion of the rack to the next and fall into place to allow the LEDs to illuminate the contents in the bottles. In such an arrangement a group of items would be illuminated and as one item is removed, another item would fall into place and remain glowing.

Example and Method 2

FIGS. 6 & 7A

A fixture of an embodiment, according to the present invention, may be a peg board, mounted in a substantially upright manner. The device of the embodiment may be a member such as a peg, as used in markets for display, and the products (lighted items) may be in the form of a plastic pouch (i.e. a pouch containing shampoo). The peg board is provided DC power from an AC outlet through an AC to DC transformer. In turn, the peg has been configured to have means such as wires in the back of the board to accept power and means to supply power such as conductors integrated into the stem of the peg (e.g., external power source)—the conductors are in communication with the wires. The plastic pouches have one LED each. The LED in each pouch is advantageously coupled to the contents of the pouch to appropriately introduce light into the contents and allow the pouches to glow. The pouches each further having an attachment, each attachment including a battery (e.g., the internal power source) and switching means such as a spring or magnetic switch to turn the LED on and/or off. The pressure sensitive switch in this embodiment is configured to allow current be drawn from the conductors when the container is hanging from the peg, as a result of the pressure exerted on the switch by the weight of the pouch. By this method, the switch allows current to flow from the battery to the LED, as the pouch is removed (e.g., the pressure is relieved as a result of removing the pouch off the peg). By this method, the pouch remains glowing whether on the peg or off the peg. The attachment may further include timing means or devices to turn the LED off after a certain period to conserve the life of the battery.

In general, it is within the scope of this invention that light-modifying elements may be combined with the embodiment of the present invention to enhance the functionality of the embodiments. For instance, light modifying forms such as optical fibers, lenses, holograms, refractors, gratings and/or reflectors may be combined with the present embodiments to make an item more noticeable or appealing.

It is within the scope of this invention that any power source such as direct-current (DC) batteries, solar energy, regular alternating current (AC), 110 or 220 volt electric among other power sources can be used with appropriate circuitry means. The circuitry means may include transformers to convert electricity from AC to DC, resistors to reduce voltage and or constant current resistors among other electronic components.

It is within the scope of this invention that the light element, the internal power source and other electronic means and components provided are interchangeable with similar items or replaceable. For instance, disposable batteries can be replaced with rechargeable batteries.

It is within the scope of this invention that the light from the lighted elements may be configured to emanate light or to project a light to illuminate an area outside the item.

What is claimed is:

1. A container holding device comprising holding mean for holding at least one container having a cap;

the holding mean having conductive means to provide electric power to the at least one container cap;

the at least one cap comprising;

an outer portion;

an inner portion;

an illumination means affixed to said inner portion; and a conductive means affixed to said outer portion and connected to said illumination means;

whereby electrical power from an external power source applied to said conductive means causes said illumination means to illuminate.

2. A container holding device comprising holding mean for holding at least one container having a cap;

the holding mean having conductive means to provide electric power to the at least one container cap;

the at least one cap comprising;

an outer portion;

an inner portion;

an illumination means affixed to said inner portion; and an internal power source contained within said inner portion and connected to said illumination means;

whereby electrical power from said internal power source causes said illumination means to illuminate.

3. The container cap of claim 1, further comprising an internal power source and a power source switching means, whereby said switching means switches the power from the external power source to the internal power source when the external power is removed.

4. The container cap of claim 1, wherein said illuminating means comprises at least one light emitting diode.

5. The container cap of claim 1, wherein said illuminating means is an incandescent light source.

6. The container cap of claim 2, wherein said illuminating means comprises at least one light emitting diode.

7. The container cap of claim 2, wherein said illuminating means is an incandescent light source.

8. The container cap of claim 2, wherein said internal power source comprises a rechargeable battery.

9. The container cap of claim 2, wherein said internal power source comprises at least one capacitor.

10. A container holding device comprising a holding means for holding at least one container having the cap of claim 1, and a means for supplying electrical power to said cap.

11. A container holding device comprising a means for holding at least one container having the cap of claim 3, and means for supplying electrical power to said cap.

12. The container holding device of claim 10, wherein said holding means comprises at least one spring, said spring connected to two members, whereby the spring exerts force that draws the two members together, thereby holding a container.

13. The container holding device of claim 11, wherein said holding means comprises at least one spring, said spring connected to two members, whereby the spring exerts force that draws the two members together, thereby holding a container.

14. A container dispensing apparatus, comprising;

a means for storing a plurality of containers, each of said containers having a cap at the top, said cap having at least a portion of the top allowing light to pass through said top;

a plurality of illuminating means, including at least a first illuminating means and a second illuminating means, each said illuminating means placed above one of said containers, whereby each said illuminating means is aligned with the cap of one of said containers, such that light from the illuminating means passes through the cap, and into one of said containers; and a means for guiding each of said containers, whereby when a container is removed from the container dispensing apparatus, the container aligned under the first illuminating means moves to a new position aligned under the second illuminating means.

15. The container dispensing apparatus of claim 14, wherein each said plurality of illuminating means comprises at least one light emitting diode.

16. The container dispensing apparatus of claim 14, wherein each said plurality of illuminating means comprises at least one incandescent light source.

* * * * *